US008351827B2

(12) United States Patent
Yoshii

(10) Patent No.: US 8,351,827 B2
(45) Date of Patent: Jan. 8, 2013

(54) POWDER SUPPLY DEVICE AND IMAGE FORMING APPARATUS

(75) Inventor: Tatsuhiko Yoshii, Osaka (JP)

(73) Assignee: Kyocera Mita Corporation (JP)

( * ) Notice: Subject to any disclaimer, the term of this patent is extended or adjusted under 35 U.S.C. 154(b) by 419 days.

(21) Appl. No.: 12/766,580

(22) Filed: Apr. 23, 2010

(65) Prior Publication Data

US 2010/0272473 A1 Oct. 28, 2010

(30) Foreign Application Priority Data

Apr. 27, 2009 (JP) ..... 2009-107763

(51) Int. Cl.
*G03G 15/08* (2006.01)
*G03G 15/00* (2006.01)

(52) U.S. Cl. ..... 399/254; 399/167

(58) Field of Classification Search ..... 399/254–256, 399/167

See application file for complete search history.

(56) References Cited

U.S. PATENT DOCUMENTS 4,796,050 A * 1/1989 Furuta et al. ..... 399/167
5,933,687 A * 8/1999 Okuno et al. ..... 399/167
7,359,651 B2 4/2008 Nishitani et al.
7,995,938 B2 * 8/2011 Ryu ..... 399/44
2007/0019994 A1 * 1/2007 Choi ..... 399/254

FOREIGN PATENT DOCUMENTS

JP 2006-184611 7/2006
JP 2006-184620 7/2006
JP 2006-201314 8/2006

* cited by examiner

*Primary Examiner* — Walter L Lindsay, Jr.
*Assistant Examiner* — Rodney Bonnette
(74) *Attorney, Agent, or Firm* — Gerald E. Hespos; Michael J. Porco

(57) ABSTRACT

A powder supply device includes: first and second storage sections that store powder, first and second stirring sections arranged inside the first and second storage sections, a drive section that produces a forward direction rotational force and a reverse direction rotational force to apply a drive force to the first and second stirring sections, first and second transmission shafts that transmit the drive force to the first and second stirring sections, and a transmission switching section that transmits the drive force produced by the forward direction rotational force of the drive section to the first transmission shaft, and that transmits the drive force produced by the reverse direction rotational force of the drive section to the first transmission shaft and the second transmission shaft.

16 Claims, 9 Drawing Sheets

POWDER SUPPLY DEVICE AND IMAGE FORMING APPARATUS

BACKGROUND OF THE INVENTION

1. Field of the Invention

The present invention relates to powder supply devices and image forming apparatuses.

2. Description of the Related Art

Toner supply devices, which supply toner required for carrying out image forming, are provided in image forming apparatuses. Toner containers, which store toner for carrying out image forming, are provided in toner supply devices.

One type of toner supply device is a toner supply device that is employed in image forming apparatuses capable of color printing. There is a developing agent replenishing device (toner supply device) of this type of toner supply device that stores developing agents (toner) of multiple different colors for carrying out color printing.

Toner supply devices are provided with functions such as the following. Here, functions are shown of a toner supply device that stores toner of multiple different colors as one example of these functions. The toner supply device is provided with toner hoppers for storing toner of each color (for example, black, yellow, cyan, and magenta). A transport spiral for toner transport and a stirring paddle for toner stirring are provided inside each toner hopper. The toner stored in the toner hopper is transported in a transport spiral direction while being stirred by rotation of the stirring paddle. The toner that is transported in the transport spiral direction gathers near a toner supply opening due to rotation of the transport spiral. And toner is supplied from the toner supply opening to a developing section.

Incidentally, greater compactness and lower prices are sought for in image forming apparatuses. Accordingly, methods have been employed aiming to provide compactness and reduce costs in toner supply devices by using a single drive source to drive multiple stirring paddles, thereby reducing the number of drive sources.

However, when there is a single drive source, all the stirring paddles rotate simultaneously even when image forming is carried out using only black toner for example (monochrome printing). In this case, the toners of colors other than black are stirred unnecessarily. Excessive stirring of toners in this manner incurs toner deterioration and is a cause of image degradation. Further still, power consumption is increased since a load is placed on the drive source to no purpose.

SUMMARY OF THE INVENTION

An object of the present invention is to prevent powder being stirred unnecessarily by performing control so that only stirring paddles corresponding to the powder intended for use are rotated.

A powder supply device according to one aspect of the present invention, having: a first storage section that stores powder; a second storage section that stores the powder; a first stirring section that is provided for stirring the powder stored in the first storage section and that is arranged inside the first storage section; a second stirring section that is provided for stirring the powder stored in the second storage section and that is arranged inside the second storage section; a drive section that produces a forward direction rotational force and a reverse direction rotational force to apply a drive force to the first and second stirring sections; a first transmission shaft that transmits the drive force to the first stirring section; a second transmission shaft that transmits the drive force to the second stirring section; and a transmission switching section that transmits the drive force produced by the forward direction rotational force of the drive section to the first transmission shaft, and that transmits the drive force produced by the reverse direction rotational force of the drive section to the first transmission shaft and the second transmission shaft.

DETAILED DESCRIPTION OF THE PREFERRED EMBODIMENTS

Hereinafter, description is given regarding a powder supply device and an image forming apparatus according to an embodiment of the present invention. The image forming apparatus according to one embodiment of the present invention is an electrophotographic image forming apparatus and, for example, can be applied to a printer, a copier, a fax machine, or a multifunction machine that is integrally provided with these functions.

Figure 1:
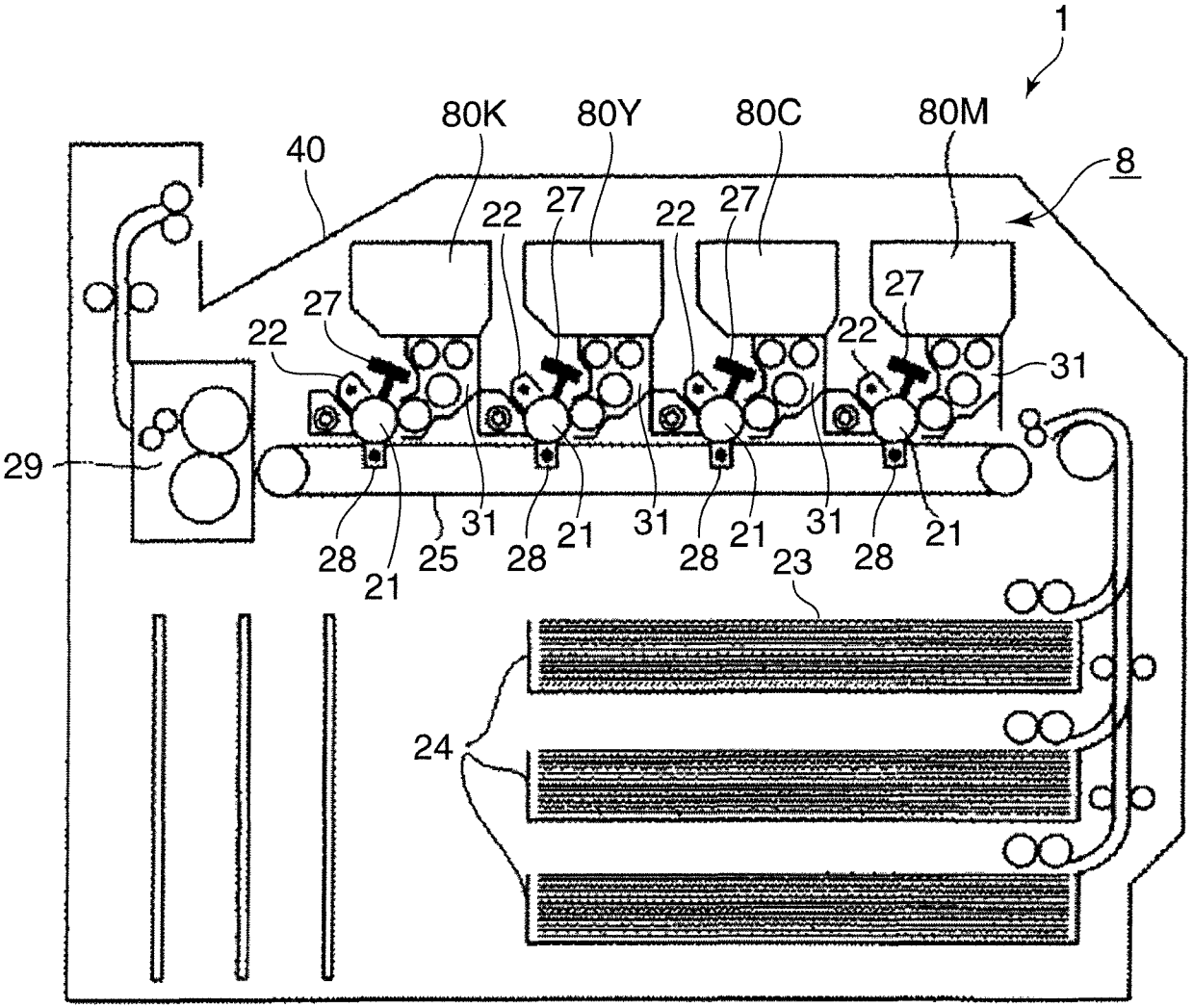
FIG. 1 is an outline cross-sectional view showing one example of an image forming apparatus according to an embodiment of the present invention.

FIG. 1 is an outline cross-sectional view showing one example of an image forming apparatus according to an embodiment of the present invention. It should be noted that in FIG. 1, a tandem system image forming apparatus 1 is illustrated as an example of an image forming apparatus according to one embodiment of the present invention. However, an image forming apparatus according to the present invention can also be an image forming apparatus using an intermediate transfer belt system.

In FIG. 1, the image forming apparatus 1 is provided with photosensitive structures 21, which are capable of carrying an electrostatic latent image by being charged, charging devices 22 that charge the photosensitive structures 21, exposure units 27 that form the electrostatic latent images on the photosensitive structures 21, development devices 31 that supply toner (powder) to the photosensitive structures 21 to make visible toner images, and transfer devices 28 that transfer the toner images formed on the photosensitive structures 21 to a transported paper 23.

Furthermore, a toner supply device (powder supply device) 8 is detachably arranged in the image forming apparatus 1 to supply toner to each of the development devices 31. The toner supply device 8 is provided with a black toner hopper 80K (hereinafter referred to as toner hopper 80K) that stores black toner to be supplied to the corresponding development device 31 and a yellow toner hopper 80Y (hereinafter referred to as toner hopper 80Y) that stores yellow toner to be supplied to the corresponding development device 31.

Further still, the toner supply device 8 is provided with a cyan toner hopper 80C (hereinafter referred to as toner hopper 80C) that stores cyan toner to be supplied to the corresponding development device 31 and a magenta toner hopper 80M (hereinafter referred to as toner hopper 80M) that stores magenta toner to be supplied to the corresponding development device 31. In this toner supply device 8, the toner hopper 80K constitutes a first storage section. Furthermore, the toner hoppers 80Y, 80C, and 80M constitute second storage sections.

Furthermore, in addition to the above components, the image forming apparatus 1 is provided with paper feeding cassettes 24 that contain papers 23, a transport belt 25 that draws out and transports the papers 23 from the paper feeding cassettes 24, and a fixing device 29 that fixes the toner images of each color that have been transferred onto the paper 23. The paper 23, on which the toner images have been fixed by the fixing device 29, is discharged to a paper discharge tray 40.

Figure 2:
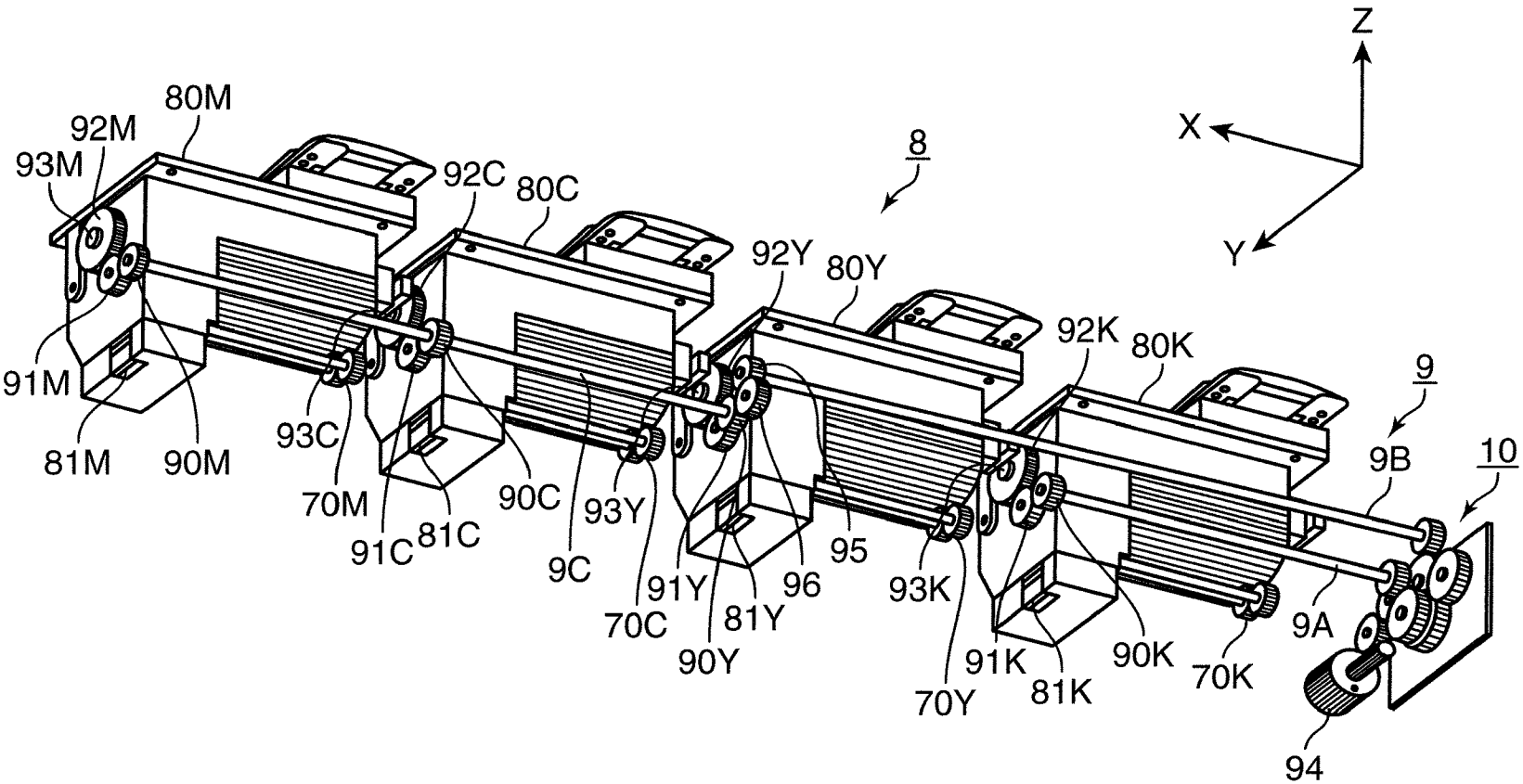
FIG. 2 is a perspective view showing one example of a powder supply device according to an embodiment of the present invention.

FIG. 2 is a perspective view showing one example of a powder supply device according to an embodiment of the present invention. It should be noted that in FIG. 2, the toner supply device 8 is illustrated as an example of a powder supply device according to the present invention.

The toner supply device 8 is constituted by the toner hoppers 80K, 80Y, 80C, and 80M, and a paddle drive mechanism 9, which is described later.

In the toner supply device 8, gears 91K, 91Y, 91C, and 91M are provided at outer sides of the toner hoppers 80K, 80Y, 80C, and 80M respectively. The gear 91K meshes with a paddle drive gear 90K, which is described later. The gear 91Y meshes with a paddle drive gear 90Y, which is described later. The gear 91C meshes with a paddle drive gear 90C, which is described later. The gear 91M meshes with a paddle drive gear 90M, which is described later.

Furthermore, paddle gears 92K, 92Y, 92C, and 92M are arranged at outer sides of the toner hoppers 80K, 80Y, 80C, and 80M respectively. The paddle gear 92K meshes with the gear 91K. The paddle gear 92Y meshes with the gear 91Y. The paddle gear 92C meshes with the gear 91C. The paddle gear 92M meshes with the gear 91M.

The paddle gears 92K, 92Y, 92C, and 92M are secured concentrically on shafts 93K, 93Y, 93C, and 93M at one end side of the shafts 93K, 93Y, 93C, and 93M, and can rotate integrally with the shafts 93K, 93Y, 93C, and 93M.

The paddle drive gears 90K, 90Y, 90C, and 90M constitute a portion of the paddle drive mechanism 9, which is described later. When the toner hoppers 80K, 80Y, 80C, and 80M are attached to the image forming apparatus 1 from an upper side in a Z axis direction, the paddle drive gears 90K, 90Y, 90C, and 90M mess with the gears 91K, 91Y, 91C, and 91M respectively.

Thus, when each of the paddle drive gears 90K, 90Y, 90C, and 90M rotates, each of their rotational forces is transmitted to the paddle gears 92K, 92Y, 92C, and 92M via the gears 91K, 91Y, 91C, and 91M. Thus, the paddle gears 92K, 92Y, 92C, and 92M rotate when the paddle drive gears 90K, 90Y, 90C, and 90M rotate. When this happens, the shafts 93K, 93Y, 93C, and 93M rotate integrally with the paddle gears 92K, 92Y, 92C, and 92M.

Figure 3:
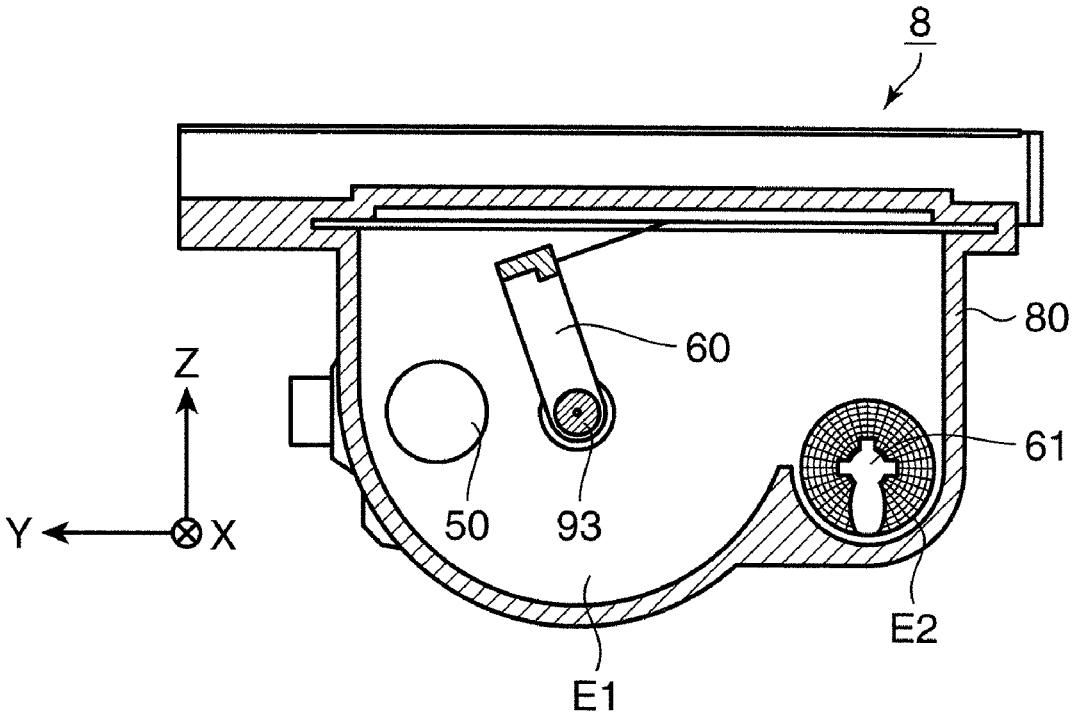
FIG. 3 is a lateral cross-sectional view showing one example of the toner supply device.

A stirring paddle (stirring section) 60 and a transport spiral 61 are arranged inside each of the toner hoppers 80K, 80Y, 80C, and 80M as shown in FIG. 3. FIG. 3 is a lateral cross-sectional view showing one example of the toner supply device 8 when viewed from an X direction. Here, the stirring paddle 60 arranged inside the toner hopper 80K constitutes a first stirring section. Furthermore, the stirring paddles 60 arranged inside each of the toner hoppers 80Y, 80C, and 80M constitute second stirring sections.

The transport spiral 61 is a name that collectively indicates the transport spirals arranged in each of the toner hoppers 80K, 80Y, 80C, and 80M. Furthermore, the shaft 93 is a name that collectively indicates the shafts 93K, 93Y, 93C, and 93M arranged in each of the toner hoppers 80K, 80Y, 80C, and 80M.

As shown in FIG. 3, the stirring paddle 60 is provided in a central area of a major region E1 having a substantially U-shaped bottom surface positioned in a Y axis direction in the toner hopper 80 (a name that collectively indicates the toner hoppers 80K, 80Y, 80C, and 80M), and can rotate centered on the shaft 93 as a central axis when the shaft 93 rotates. Thus, when the shaft 93 rotates due to the rotational force of the paddle gear 92, the stirring paddle 60 can rotate centered on the shaft 93 as a central axis. When the stirring paddle 60 rotates, the toner stored in the toner hopper 80 is stirred and transported toward the transport spiral 61.

Furthermore, a sensor 50 that detects a remaining amount of toner is arranged in the major region E1 of the toner hopper 80 at a same height as the shaft 93 in the Z axis direction. The remaining amount of toner detected by the sensor 50 is notified to a control section 100, which is described later. The control section 100 gives an alarm if it determines that the remaining amount of toner is low.

Hereinafter, description is given of functions of the transport spiral 61 with reference to FIG. 2 and FIG. 3. The transport spiral 61 is provided in a minor region E2 having a substantially U-shaped bottom surface, which is provided in positions corresponding to toner supply openings 81K, 81Y, 81C, and 81M in the toner hoppers 80, and performs transport so that toner gathers near the toner supply openings 81K, 81Y, 81C, and 81M. The transport spirals 61 rotate due to a drive force produced by rotation of transport spiral drive motors 70K, 70Y, 70C, and 70M, which are arranged corresponding to the toner hoppers 80K, 80Y, 80C, and 80M. Toner that has gathered near the toner supply openings 81K, 81Y, 81C, and 81M is supplied from the toner supply openings 81K, 81Y, 81C, and 81M to each of the development devices 31.

Furthermore, in FIG. 2, a shaft drive motor (drive section) 94 rotates in a forward direction and a reverse direction and applies a drive force to the stirring paddle 60 arranged in each of the toner hoppers 80K, 80Y, 80C, and 80M. The toner supply device 8 is provided with the stirring paddle drive mechanism 9 indicated below so that a drive force can be applied to each of the stirring paddles by the shaft drive motor 94 rotating in a forward direction and a reverse direction. It should be noted that in FIG. 2, the toner supply device 8 is provided with relay gears 95 and 96. Functions of the relay gears 95 and 96 are described later.

Figure 4:
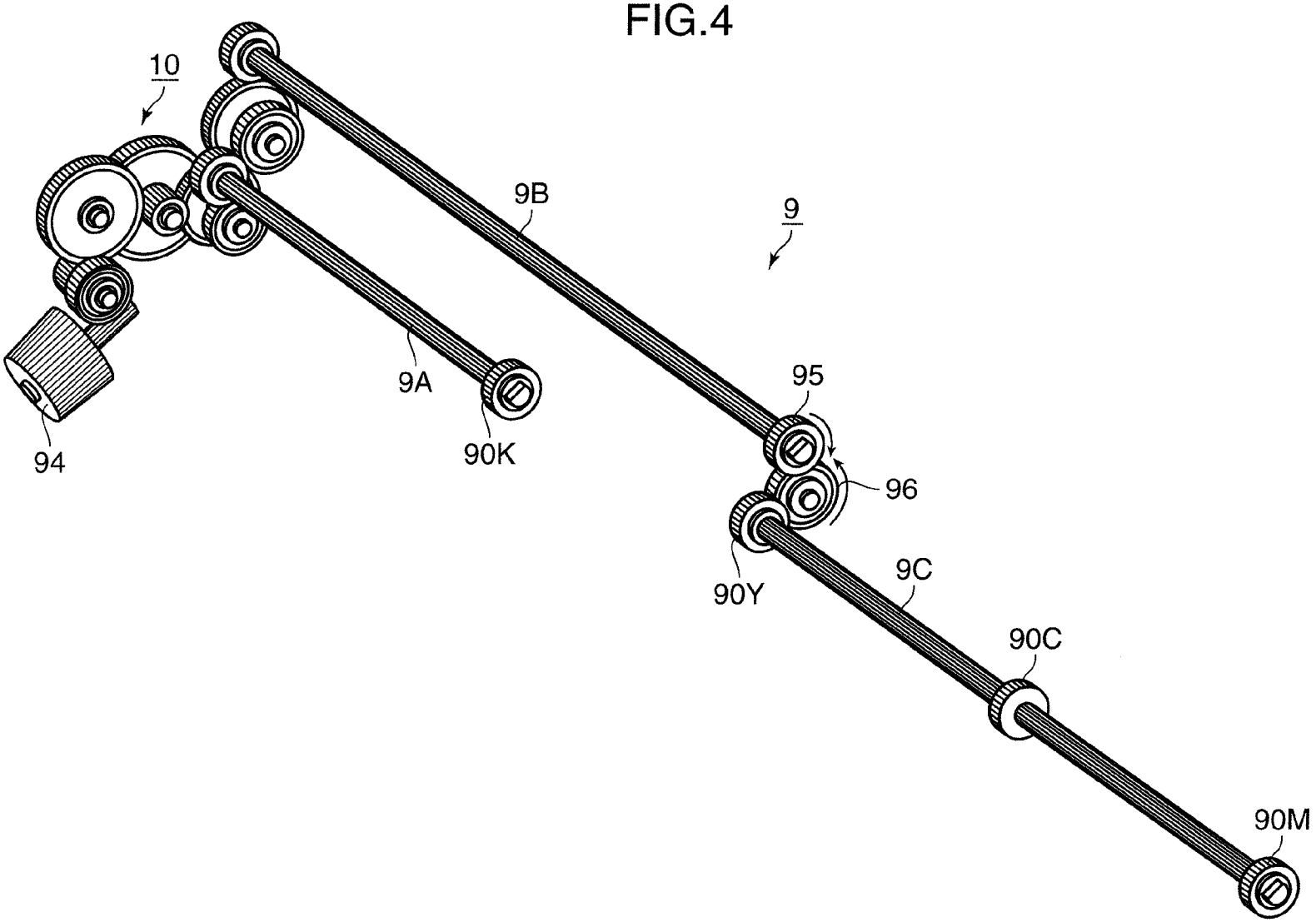
FIG. 4 is a perspective view showing one example of a stirring paddle drive mechanism.

FIG. 4 is a perspective view showing one example of a stirring paddle drive mechanism. The stirring paddle drive mechanism 9 is provided with the shaft drive motor 94, a transmission switching section 10, a first shaft (first transmission shaft) 9A, a second shaft (second transmission shaft) 9B, a third shaft 9C, the relay gear 95, the relay gear 96, and the paddle drive gears 90K, 90Y, 90C, and 90M.

In the stirring paddle drive mechanism 9, the paddle drive gear 90K is secured concentrically on the first shaft 9A at one end side of the first shaft 9A, and rotates integrally with the first shaft 9A. The paddle drive gear 90Y is secured concentrically on the third shaft 9C at one end side of the third shaft 9C, and rotates integrally with the third shaft 9C. The paddle drive gear 90C is secured concentrically on the third shaft 9C at a central area of the third shaft 9C, and rotates integrally with the third shaft 9C. The paddle drive gear 90M is secured concentrically on the third shaft 9C at another end side of the third shaft 9C, and rotates integrally with the third shaft 9C.

Furthermore, in the stirring paddle drive mechanism 9, the relay gear 95 is secured concentrically on the second shaft 9B at one end side of the second shaft 9B, and rotates integrally with the second shaft 9B. This relay gear 95 meshes with the relay gear 96. And the relay gear 96 meshes with the paddle drive gear 90Y, which is secured on the one end side of the third shaft 9C. Thus, the rotational force of the second shaft 9B is transmitted to the third shaft 9C via the relay gears 95 and 96.

In the stirring paddle drive mechanism 9, forward direction rotational force produced by the shaft drive motor 94 is transmitted to the first shaft 9A as a drive force by the transmission switching section 10. Due to this, the first shaft 9A rotates. When the first shaft 9A rotates, the paddle drive gear 90K rotates in a same direction as the first shaft 9A. Due to this, the stirring paddle 60 arranged in the toner hopper 80K rotates.

On the other hand, in the stirring paddle drive mechanism 9, reverse direction rotational force produced by the shaft drive motor 94 is transmitted to the first shaft 9A and the second shaft 9B by the transmission switching section 10. Due to this, the first shaft 9A and the second shaft 9B rotate. When the first shaft 9A rotates, the paddle drive gear 90K rotates in the same direction as the first shaft 9A, and therefore the stirring paddle 60 arranged in the toner hopper 80K rotates.

Furthermore, when the second shaft 9B rotates, the relay gear 95 rotates in the same direction as the second shaft 9B. When this happens, the rotational force of the relay gear 96 rotating in a reverse direction to the relay gear 95 is transmitted to the paddle drive gear 90Y secured on the one end side of the third shaft 9C. Due to this, a rotational force of a reverse direction to the rotational force of the relay gear 96 is transmitted to the third shaft 9C via the paddle drive gear 90Y, and therefore the third shaft 9C rotates in the same direction as the second shaft 9B. Due to this, the paddle drive gears 90Y, 90C, and 90M, which are secured to the third shaft 9C, rotate in the same direction as the second shaft 9B. Accordingly, the stirring paddles 60 arranged in the toner hoppers 80Y, 80C, and 80M rotate.

Figure 5A:
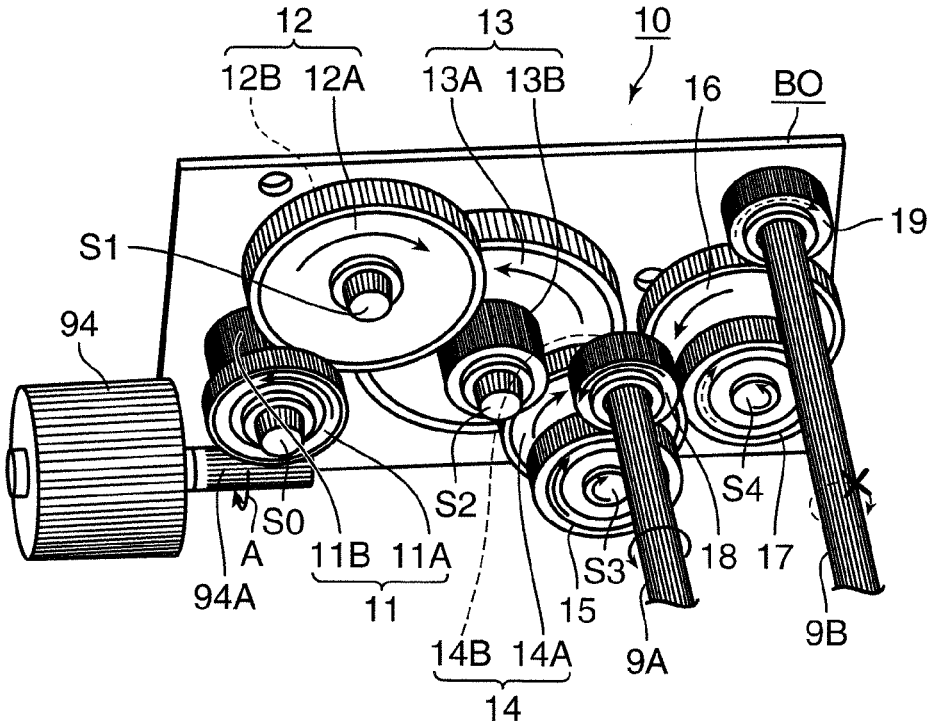
FIGS. 5A and 5B are diagrams showing one example of a configuration of a transmission switching section.
Figure 5B:
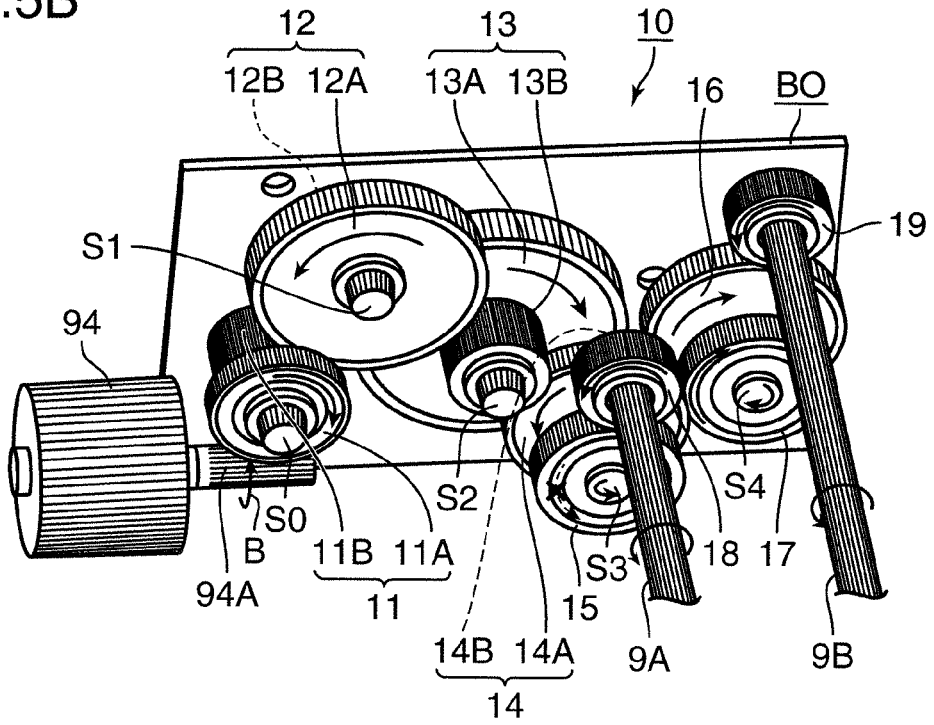

FIGS. 5A and 5B are diagrams showing one example of a configuration of a transmission switching section. FIG. 5A is a diagram showing a condition when the shaft drive motor 94 is rotating in a forward direction. And FIG. 5B is a diagram showing a condition when the shaft drive motor 94 is rotating in a reverse direction.

As shown in FIGS. 5A and 5B, the transmission switching section 10 is configured as shown below. The transmission switching section 10 is provided with a first gear 11, a second gear 12, a third gear 13, a fourth gear 14, a unidirectional (one-way) gear (first unidirectional transmission section) 15, a fifth gear 16, a unidirectional (one-way) gear (second unidirectional transmission section) 17, a relay gear (first transmission section) 18, and a relay gear (second transmission section) 19.

In the transmission switching section 10, the relay gear 18 is secured concentrically on the first shaft 9A at the other end side of the first shaft 9A, and rotates integrally with the first shaft 9A. Furthermore, the relay gear 19 is secured concentrically on the second shaft 9B at the other end side of the second shaft 9B. This relay gear 19 is constituted by a unidirectional (one-way) gear (third unidirectional transmission section) having a following property.

That is, when a rotational force is transmitted of a counterclockwise direction in FIGS. 5A and 5B of a gear (the fifth gear 16 in FIGS. 5A and 5B) that contacts with this unidirectional gear, this unidirectional gear rotates idly in a clockwise direction in FIGS. 5A and 5B on the second shaft 9B without transmitting this rotational force to the second shaft 9B. On the other hand, when a rotational force is transmitted of a clockwise direction in FIGS. 5A and 5B of a gear (the fifth gear 16 in FIGS. 5A and 5B) that contacts with this unidirectional gear, this unidirectional gear rotates integrally in a counterclockwise direction in FIGS. 5A and 5B with the second shaft 9B by transmitting this rotational force to the second shaft 9B. A unidirectional having the above property constitutes the relay gear 19.

The first gear 11 is axially supported in a rotatable state centered on a shaft S0 as a central axis, with the shaft S0 being formed on a base BO. The first gear 11 meshes with a rotational shaft 94A of the shaft drive motor 94 and is constituted by a large diameter section 11A, to which is transmitted the rotational force produced by the rotation of the rotational shaft 94A, and a small diameter section 11B, which transmits the rotational force that has been transmitted to the large diameter section 11A to later stages.

The second gear 12 is axially supported in a rotatable state centered on a shaft S1 as a central axis, with the shaft S1 being formed on the base BO. The second gear 12 meshes with the small diameter section 11B of the first gear 11, and is constituted by a large diameter section 12A, to which is transmitted the rotational force from the small diameter section 11B of the first gear 11, and a small diameter section 12B, which transmits the rotational force that has been transmitted to the large diameter section 12A to later stages.

The third gear 13 is axially supported in a rotatable state centered on a shaft S2 as a central axis, with the shaft S2 being formed on the base BO. The third gear 12 meshes with the small diameter section 12B of the second gear 12, and is constituted by a large diameter section 13A, to which is transmitted the rotational force from the small diameter section 12B of the second gear 12, and a small diameter section 13B, which transmits the rotational force that has been transmitted to the large diameter section 13A to later stages.

The fourth gear 14 is axially supported on the base BO so as to be capable of rotating integrally with a rotational shaft S3. The fourth gear 14 meshes with the small diameter section 13B of the third gear 13, and is constituted by a large diameter section 14A, to which is transmitted the rotational force from the small diameter section 13B of the third gear 13, and a small diameter section 14B, which transmits the rotational force that has been transmitted to the large diameter section 14A to later stages.

The unidirectional gear 15 is axially supported on the base BO so as to be capable of rotating integrally with the rotational shaft S3. The unidirectional gear 15 contacts the relay gear 18. When rotational force is transmitted of a clockwise direction in FIGS. 5A and 5B of the rotational shaft S3, to which the unidirectional gear is attached, the unidirectional gear 15 integrally rotates with the rotational shaft S3 in the clockwise direction in FIGS. 5A and 5B. On the other hand, the rotational force of the counterclockwise direction in FIGS. 5A and 5B of the rotational shaft S3 is not transmitted and the unidirectional gear 15 rotates idly in the clockwise direction in FIGS. 5A and 5B on the rotational shaft S3. Thus, when the rotational shaft S3 rotates in the clockwise direction, the unidirectional gear 15 rotates integrally with the rotational shaft S3 due to the rotational force thereof. Accordingly, the rotational force of the rotational shaft S3 is transmitted to the relay gear (see FIG. 5A). On the other hand, when the rotational shaft S3 rotates in the counterclockwise direction in FIGS. 5A and 5B, the unidirectional gear 15 rotates idly on the rotational shaft S3. Thus, the unidirectional gear 15 does not transmit the rotational force of the rotational shaft S3 to the relay gear 18 (see FIG. 5B).

The fifth gear 16 is axially supported on the base BO so as to be capable of rotating integrally with a rotational shaft S4. The fifth gear 16 meshes with the small diameter section 14B of the fourth gear 14 and rotational force from the small diameter section 14B of the fourth gear 14 is transmitted to the fifth gear 16. The fifth gear 16 contacts the relay gear 19, and rotational force transmitted from the small diameter section 14B of the fourth gear 14 is further transmitted to the relay gear 19.

The unidirectional gear 17 is axially supported on the base BO so as to be capable of rotating integrally with the rotational shaft S4. The unidirectional gear 17 contacts the relay gear 18. The rotational force of the counterclockwise direction in FIGS. 5A and 5B of the rotational shaft S4, to which the unidirectional gear 17 is attached, is not transmitted, and the unidirectional gear rotates idly in the clockwise direction on the rotational shaft S4. On the other hand, when rotational force is transmitted of a clockwise direction in FIGS. 5A and 5B of the rotational shaft S4, to which the unidirectional gear 17 is attached, the unidirectional gear integrally rotates with the rotational shaft S4. Thus, when the rotational shaft S4 rotates in the clockwise direction in FIGS. 5A and 5B, the unidirectional gear 17 rotates integrally with the rotational shaft S4 due to the rotational force thereof. Accordingly, the rotational force of the rotational shaft S4 is transmitted to the relay gear (see FIG. 5B). On the other hand, when the rotational shaft S4 rotates in the counterclockwise direction, the unidirectional gear 17 rotates idly on the rotational shaft S4. Thus, the unidirectional gear 17 does not transmit the rotational force of the rotational shaft S4 to the relay gear 18 (see FIG. 5A).

Furthermore, when a rotational force is transmitted of a counterclockwise direction in FIGS. 5A and 5B of a gear (the relay gear 18 in FIGS. 5A and 5B) that contacts with the unidirectional gear 17, the unidirectional gear 17 rotates idly on the rotational shaft S4 without transmitting this rotational force to the rotational shaft S4. On the other hand, when a rotational force is transmitted of a clockwise direction in FIGS. 5A and 5B of the gear (the relay gear 18 in FIGS. 5A and 5B) that contacts with the unidirectional gear 17, the unidirectional gear 17 rotates integrally with the rotational shaft S4 by transmitting this rotational force to the rotational shaft S4.

In the description indicated below, "forward direction rotational force" refers to a rotational force produced by rotation of the rotational shaft 94A of the shaft drive motor 94 in an arrow A direction shown in FIG. 5A. Furthermore, "reverse direction rotational force" refers to a rotational force produced by rotation of the rotational shaft 94A of the shaft drive motor 94 in an arrow B direction shown in FIG. 5B.

The transmission switching section 10 operates as shown in FIG. 5A when the shaft drive motor 94 produces forward direction rotational force. That is, each of the first gear 11, the second gear 12, and the third gear 13 rotates in a direction indicated by a solid line arrow. When this happens, the fourth gear 14 rotates integrally with the rotational shaft S3 in a direction indicated by the solid line arrow. Here, the unidirectional gear 15 rotates integrally with the rotational shaft S3 in the arrow direction, and therefore the rotational force of the rotational shaft S3 is transmitted to the relay gear 18. Then the relay gear 18 rotates in the arrow direction. Thus, the first shaft 9A rotates in the arrow direction.

On the other hand, the rotational force of the fourth gear 14 is transmitted to the fifth gear 16, and therefore the fifth gear 16 rotates integrally with the rotational shaft S4 in the arrow direction (see FIG. 5A). Thus, the rotational force of the fifth gear 16 that contacts the relay gear 19 is transmitted to the relay gear 19. However, since the rotational force of the fifth gear 16 is a counterclockwise direction in FIGS. 5A and 5B, the relay gear 19 does not transmit the rotational force of the fifth gear 16 to the second shaft 9B and rotates idly on the second shaft 9B. Thus, the rotational force of the fifth gear 16 is not transmitted to the second shaft 9B. Accordingly, the second shaft 9B maintains a stationary condition.

Incidentally, when the relay gear 18 rotates in a counterclockwise direction indicated in FIGS. 5A and 5B, the rotational force of the relay gear 18 is transmitted to the unidirectional gear 17 that contacts the relay gear 18. However, when the rotational force of the counterclockwise direction in FIGS. 5A and 5B of the relay gear 18 that contact the unidirectional gear 17 is transmitted, the unidirectional gear 17 rotates idly in the clockwise direction in FIGS. 5A and 5B on the rotational shaft S4. Thus, the unidirectional gear 17 does not transmit the rotational force of the relay gear 18 to the rotational shaft S4. Accordingly, the torque of the relay gear 18 that causes the first shaft 9A to rotate is not reduced by the inertia of the fifth gear 16, the relay gear 19, the rotational shaft S4, the second shaft 9B, and the components arranged on the second shaft 9B side (the stirring paddles 60 and so on).

On the other hand, the transmission switching section 10 operates as shown in FIG. 5B when the shaft drive motor 94 produces reverse direction rotational force. That is, each of the first gear 11, the second gear 12, and the third gear 13 rotates in a direction indicated by a solid line arrow. When this happens, the fourth gear 14 rotates integrally with the rotational shaft S3 in a direction indicated by the solid line arrow. Here, the unidirectional gear 15 rotates idly on the rotational shaft S3, and therefore the rotational force of the rotational shaft S3 is not transmitted to the relay gear 18.

On the other hand, the rotational force of the fourth gear 14 is transmitted to the fifth gear 16, and therefore the fifth gear 16 rotates integrally with the rotational shaft S4 in the arrow direction. Here, the unidirectional gear 17 rotates integrally with the rotational shaft S4 in the arrow direction, and therefore the rotational force of the rotational shaft S4 is transmitted to the relay gear 18. Thus, the first shaft 9A rotates in the arrow direction.

Furthermore, when the fifth gear 16 rotates in a clockwise direction in FIGS. 5A and 5B, the relay gear 19 rotates integrally with the second shaft 9B in a counterclockwise in FIGS. 5A and 5B. Thus, the second shaft 9B rotates in the counterclockwise direction in FIGS. 5A and 5B.

As described above, when a forward direction rotational force is produced, the rotational force is transmitted to the first shaft 9A only, while on the other hand, when a reverse direction rotational force is produced, the rotational force is transmitted to the first shaft 9A and the second shaft 9B.

Figure 6:
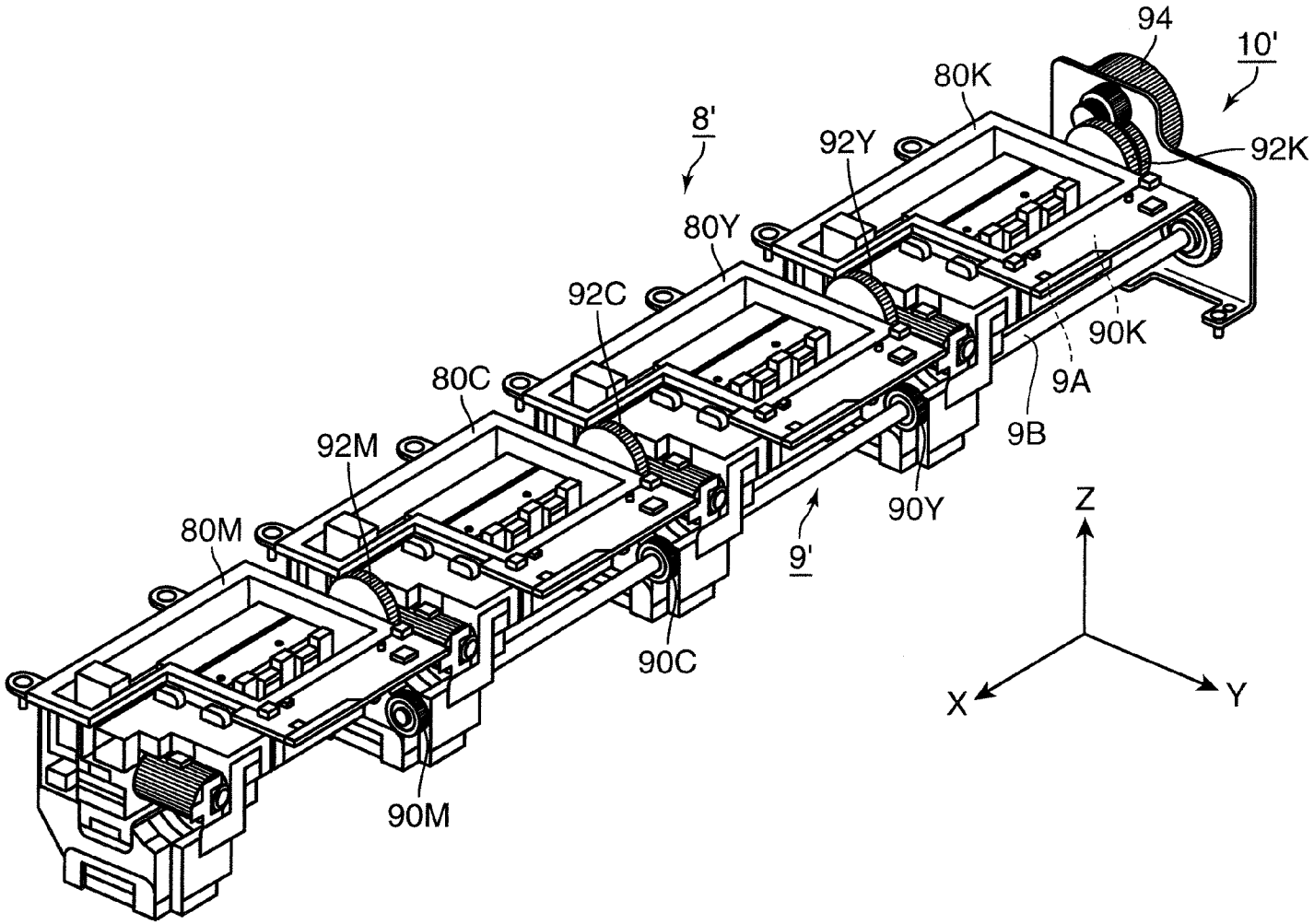
FIG. 6 is a perspective view showing another example of a toner supply device.
Figure 7:
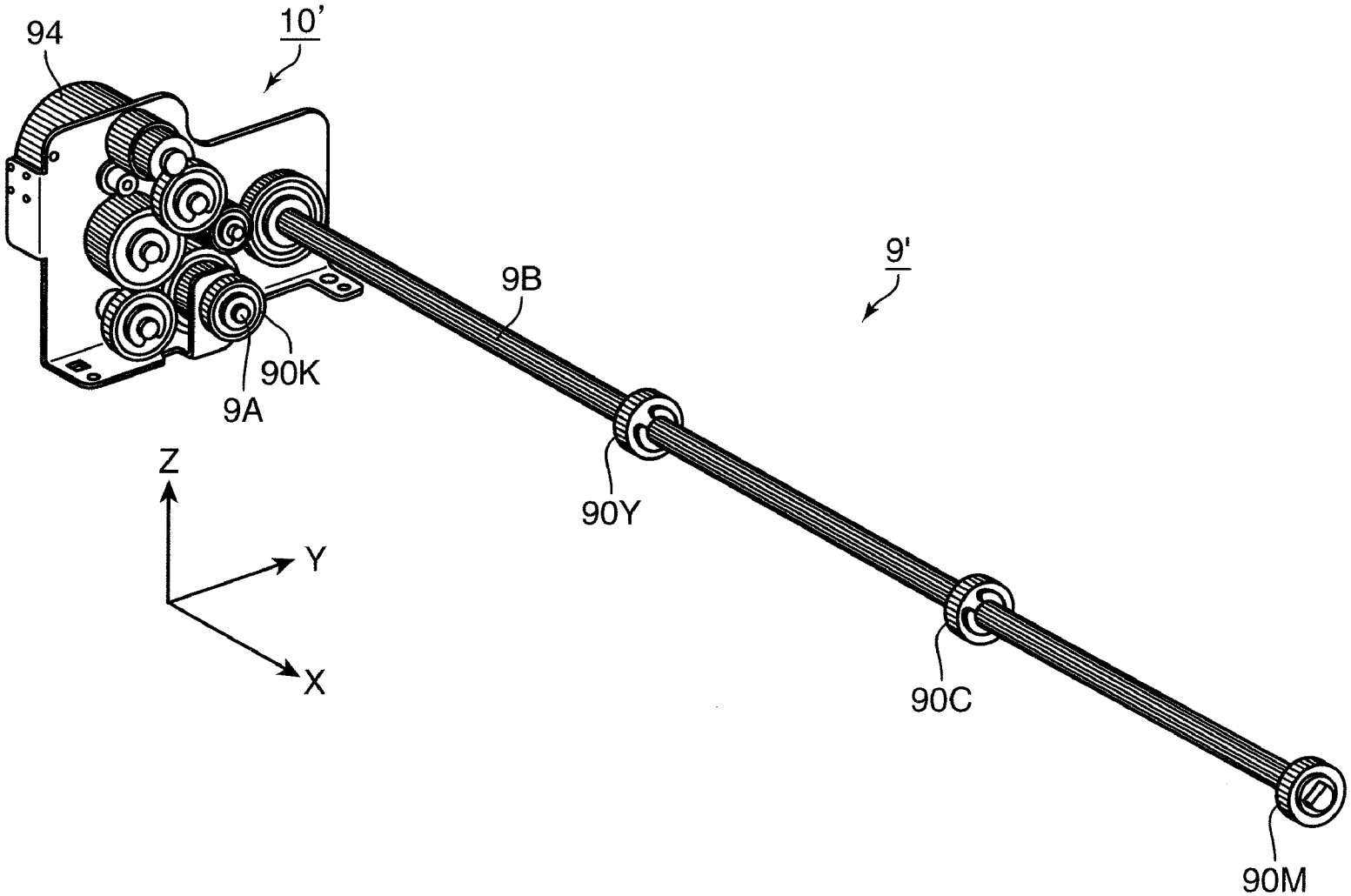
FIG. 7 is a perspective view showing another example of a stirring paddle drive mechanism.

FIG. 6 is a perspective view showing another example of a toner supply device. Furthermore, FIG. 7 is a perspective view showing another example of a stirring paddle drive mechanism. It should be noted that in FIG. 6 and FIG. 7, same symbols are assigned to same components as components shown in FIG. 2 and FIG. 4, and description thereof is omitted.

A toner supply device 8' shown in FIG. 6 is provided with a stirring paddle drive mechanism 9' shown in FIG. 7. Unlike the stirring paddle drive mechanism 9 (see FIG. 4), in the stirring paddle drive mechanism 9', the paddle drive gear 90M is secured concentrically on the second shaft 9B at one end side of the second shaft 9B, and can rotate integrally with the second shaft 9B.

Furthermore, the paddle drive gears 90Y and 90C are secured concentrically on the second shaft 9B with regular spacing in order of the paddle drive gear 90Y and 90C with respect to the X axis direction between the one end side and the other end side of the second shaft 9B, and can rotate integrally with the second shaft 9B. Further still, the paddle drive gears 90K, 90Y, 90C, and 90M mesh with the paddle gears 92K, 92Y, 92C, and 92M, but not through at least the relay gear 95 and the relay gear 96.

That is, the paddle drive gear 90K meshes with the paddle gear 92K, but not through at least the relay gear 95 and the relay gear 96. The paddle drive gear 90Y meshes with the paddle gear 92Y, but not through at least the relay gear 95 and the relay gear 96. The paddle drive gear 90C meshes with the paddle gear 92C, but not through at least the relay gear 95 and the relay gear 96. The paddle drive gear 90M meshes with the paddle gear 92M, but not through at least the relay gear 95 and the relay gear 96.

Furthermore, the stirring paddle drive mechanism 9' is provided with a transmission switching section 10' that controls transmission to the first shaft (first transmission shaft) 9A and the second shaft (second transmission shaft) 9B of the rotational force produced by the shaft drive motor 94.

In the stirring paddle drive mechanism 9', forward direction rotational force produced by the shaft drive motor 94 is transmitted to the first shaft 9A as a drive force by the transmission switching section 10'. Thus, the first shaft 9A rotates. When the first shaft 9A rotates, the paddle drive gear 90K rotates in a same direction as the first shaft 9A. Thus, the stirring paddle 60 arranged in the toner hopper 80K rotates.

On the other hand, in the stirring paddle drive mechanism 9', reverse direction rotational force produced by the shaft drive motor 94 is transmitted to the first shaft 9A and the second shaft 9B by the transmission switching section 10'. Thus, the first shaft 9A and the second shaft 9B rotate.

When the first shaft 9A rotates, the paddle drive gear 90K rotates in the same direction as the first shaft 9A, and therefore the stirring paddle 60 arranged in the toner hopper 80K rotates. Furthermore, when the second shaft 9B rotates, the paddle drive gears 90Y, 90C, and 90M rotate in the same direction as the second shaft 9B, and therefore the stirring paddles 60 arranged in the toner hoppers 80Y, 80C, and 80M rotate.

Figure 8A:
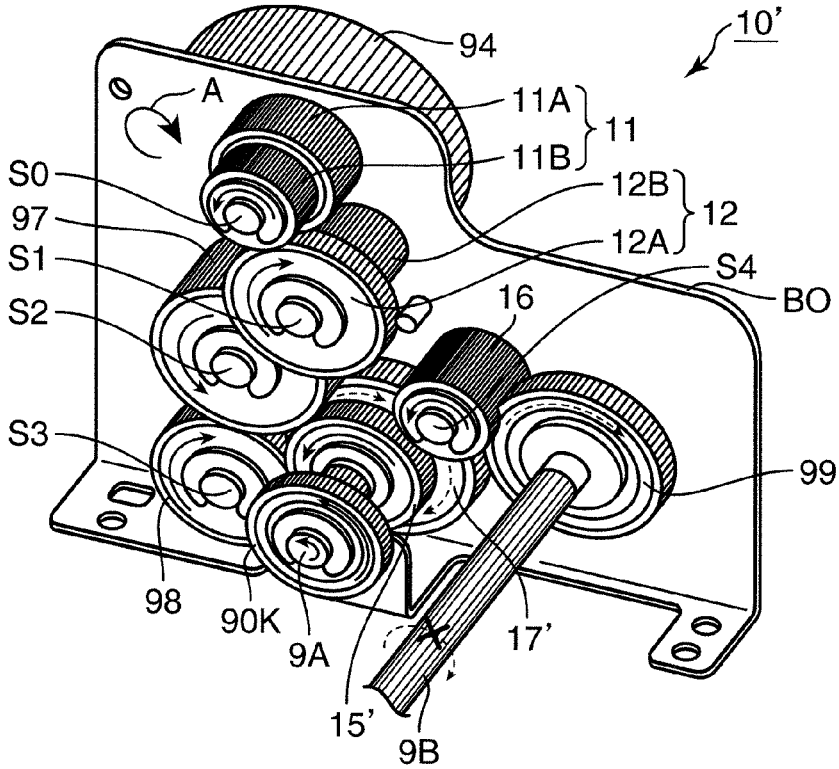
FIGS. 8A and 8B are diagrams showing another example of a configuration of a transmission switching section.
Figure 8B:
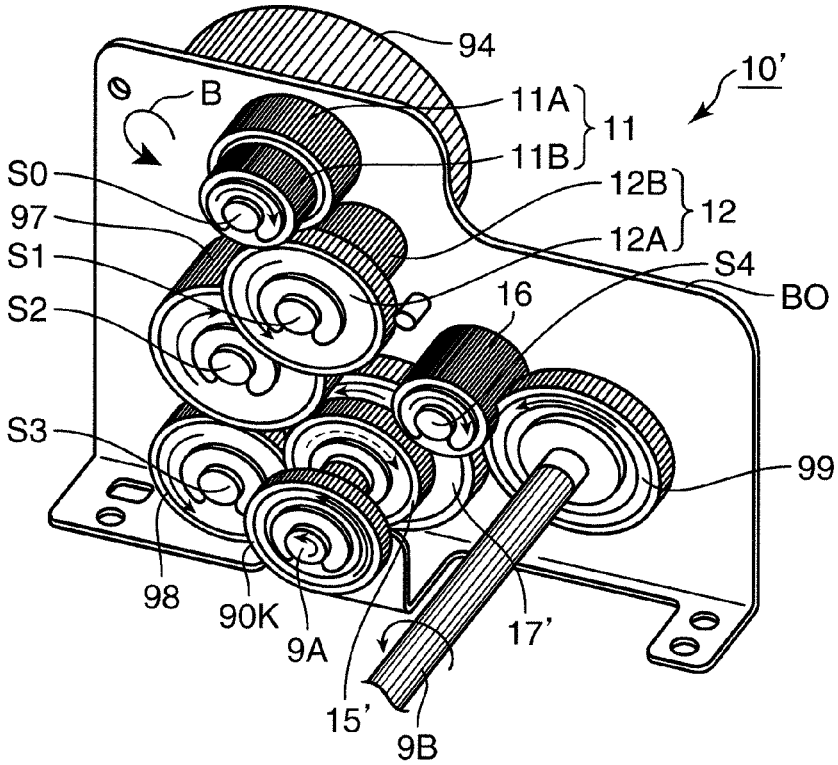

FIGS. 8A and 8B are diagrams showing another example of a configuration of a transmission switching section. FIG. 8A is a diagram showing a condition when the shaft drive motor 94 is rotating in a forward direction. And FIG. 8B is a diagram showing a condition when the shaft drive motor 94 is rotating in a reverse direction. It should be noted that same symbols are assigned to same components as components of the transmission switching section 10 shown in FIGS. 5A and 5B, and description thereof is omitted.

As shown in FIGS. 8A and 8B, the transmission switching section 10' is configured as shown below. The transmission switching section 10' is provided with a first gear 11, a second gear 12, a third gear 97, a fourth gear 98, a unidirectional (one-way) gear (first unidirectional transmission section) 15', a unidirectional (one-way) gear (second unidirectional transmission section) 17', a fifth gear 16, and a unidirectional (one-way) gear (third unidirectional transmission section) 99.

The first gear 11 is axially supported in a rotatable state centered on a shaft S0 as a central axis, with the shaft S0 being formed on a base BO. The first gear 11 meshes with a rotational shaft (not shown in drawings) of the shaft drive motor 94 and is constituted by a large diameter section 11A, to which is transmitted the rotational force produced by the rotation of the rotational shaft 94A, and a small diameter section 11B, which transmits the rotational force that has been transmitted to the large diameter section 11A to later stages.

The second gear 12 is axially supported in a rotatable state centered on a shaft S1 as a central axis, with the shaft S1 being formed on the base BO. The second gear 12 meshes with the small diameter section 11B of the first gear 11, and is constituted by a large diameter section 12A, to which is transmitted the rotational force from the small diameter section 11B of the first gear 11, and a small diameter section 12B, which transmits the rotational force that has been transmitted to the large diameter section 12A to later stages.

The third gear 97 is axially supported in a rotatable state centered on a shaft S2 as a central axis, with the shaft S2 being formed on the base BO. The third gear 97 meshes with the small diameter section 12B of the second gear 12 to transmit rotational force. Furthermore, the third gear 97 transmits rotational force to later stages (the fourth gear 98 and the unidirectional gear 17').

The fourth gear 98 is axially supported in a rotatable state centered on a shaft S3 as a central axis, with the shaft S3 being formed on a base BO. The fourth gear 98 meshes with the third gear 97 to transmit rotational force. Furthermore, the fourth gear 98 transmits rotational force to later stages (the unidirectional gear 15').

The unidirectional gear 15' is axially supported on the base BO so as to be capable of rotating integrally with the first shaft 9A at the other end side of the first shaft 9A. Furthermore, the unidirectional gear 15' contacts the fourth gear 98. When a rotational force is transmitted of a clockwise direction shown in FIGS. 8A and 8B of a gear (the fourth gear 98 in FIGS. 8A and 8B) that contacts with the unidirectional gear 15', the unidirectional gear 15' rotates integrally in a counterclockwise direction shown in FIGS. 8A and 8B with the first shaft 9A. Here, the rotational force of the fourth gear 98 is transmitted to the first shaft 9A, and therefore the first shaft 9A rotates. On the other hand, when a rotational force is transmitted of a counterclockwise direction shown in FIGS. 8A and 8B of a gear (the fourth gear 98 in FIGS. 8A and 8B) that contacts with the unidirectional gear 15', the unidirectional gear 15' rotates idly on the first shaft 9A in a clockwise direction shown in FIGS. 8A and 8B. Thus, when the rotational force of the counterclockwise direction of the fourth gear 98 is transmitted, the unidirectional gear 15' rotates idly on the first shaft 9A in the clockwise direction and the rotational force is not transmitted to the first shaft 9A.

The unidirectional gear 17' is axially supported on the base BO so as to be capable of rotating integrally with the first shaft 9A at the other end side of the first shaft 9A. Furthermore, the unidirectional gear 17' contacts the third gear 97 and the fifth gear 16. When a rotational force is transmitted of a clockwise direction shown in FIGS. 8A and 8B of a gear (the third gear 97 in FIGS. 8A and 8B) that contacts the unidirectional gear 17', the unidirectional gear 17' rotates integrally in the counterclockwise direction with the first shaft 9A. Here, the unidirectional gear 17' transmits counterclockwise direction rotational force to the first shaft 9A and the fifth gear 16. Thus, when the rotational force of the clockwise direction of the third gear 97 is transmitted, the unidirectional gear 17' rotates integrally with the first shaft 9A in the counterclockwise direction and the rotational force is transmitted to the fifth gear 16 (see FIG. 8B).

On the other hand, when a rotational force is transmitted of a counterclockwise direction shown in FIGS. 8A and 8B of a gear (the third gear 97 in FIGS. 8A and 8B) that contacts with the unidirectional gear 17', the unidirectional gear 17' rotates idly on the first shaft 9A in the clockwise direction. Thus, when the rotational force of the counterclockwise of the third gear 97 is transmitted, the unidirectional gear 17' rotates idly on the first shaft 9A in the clockwise direction and the rotational force is not transmitted to the first shaft 9A and the fifth gear 16 (see FIG. 8A).

The fifth gear 16 is axially supported in a rotatable state centered on a shaft S4 as a central axis, with the shaft S4 being formed on the base BO. The fifth gear 16 contacts the unidirectional gear 17' and a unidirectional gear 99, and the rotational force of the unidirectional gear 17' is transmitted to further transmit the transmitted rotational force to later stages (the unidirectional gear 99).

The unidirectional gear 99 is axially supported on the base BO so as to be capable of rotating integrally with the second shaft 9B at the other end side of the second shaft 9B. Furthermore, the unidirectional gear 99 contacts the fifth gear 16. When a rotational force is transmitted of a clockwise direction shown in FIGS. 8A and 8B of a gear (the fifth gear 16 in FIGS. 8A and 8B) that contacts the unidirectional gear 99, the unidirectional gear 99 rotates integrally in the counterclockwise direction with the second shaft 9B. Thus, the rotational force of the fifth gear 16 is transmitted to the second shaft 9B (see FIG. 8B).

On the other hand, when a rotational force is transmitted of a counterclockwise direction shown in FIGS. 8A and 8B of a gear (the fifth gear 16 in FIGS. 8A and 8B) that contacts with the unidirectional gear 99, the unidirectional gear 99 rotates idly on the second shaft 9B in the clockwise direction. Thus, when the rotational force of the counterclockwise direction of the fifth gear 16 is transmitted, the unidirectional gear 99 rotates idly on the second shaft 9B in the clockwise direction and the rotational force is not transmitted to the second shaft 9B (see FIG. 8A).

In the description indicated below, "forward direction rotational force" refers to a rotational force produced by rotation of the rotational shaft 94A (see FIGS. 5A and 5B) of the shaft drive motor 94 in an arrow A direction shown in FIG. 8A (clockwise direction shown in FIGS. 8A and 8B). Furthermore, "reverse direction rotational force" refers to a rotational force produced by rotation of the rotational shaft 94A in an arrow B direction shown in FIG. 8B (counterclockwise direction shown in FIGS. 8A and 8B).

The transmission switching section 10' carries out control as shown in FIG. 8A when the shaft drive motor 94 produces forward direction rotational force. That is, each of the first gear 11, the second gear 12, the third gear 97, and the fourth gear 98 rotates in a direction indicated by a solid line arrow. Here, the unidirectional gear 15'; transmits the rotational force transmitted from the fourth gear 98 to the first shaft 9A, and therefore the first shaft 9A rotates in the arrow direction.

On the other hand, the unidirectional gear 17' rotates idly on the first shaft 9A in a direction shown by a dashed line arrow due to the counterclockwise direction rotational force transmitted from the third gear 97. Here, the rotational force of the unidirectional gear 17' is transmitted to the fifth gear 16. Thus, the fifth gear 16 rotates in the counterclockwise direction and the rotational force is transmitted to the unidirectional gear 99. However, when the counterclockwise direction rotational force of the fifth gear 16 is transmitted, the unidirectional gear 99 rotates idly on the second shaft 9B in a direction shown by a dashed line arrow. Thus, rotational force is not transmitted to the second shaft 9B and therefore the second shaft 9B does not rotate.

On the other hand, the transmission switching section 10 carries out control as shown in FIG. 8B when the shaft drive motor 94 produces reverse direction rotational force. That is, each of the first gear 11, the second gear 12, the third gear 97, and the fourth gear 98 rotates in a direction indicated by a solid line arrow. Here, the unidirectional gear 15' rotates idly on the first shaft 9A in a direction shown by a dashed line arrow. On the other hand, the unidirectional gear 17' rotates integrally with the first shaft 9A in a direction shown by a solid line arrow by rotational force being transmitted from the third gear 97. Thus, the first shaft 9A rotates.

Then, the rotational force of the unidirectional gear 17' is transmitted to the fifth gear 16 and the fifth gear 16 rotates in the direction indicated by the solid line arrow. Thus, the unidirectional gear 99 rotates integrally with the second shaft 9B in a direction shown by the solid line arrow by rotational force being transmitted from the fifth gear 16. Thus, the second shaft 9B rotates.

It should be noted that the toner supply device 8 and the toner supply device 8' are illustrated as examples of powder supply devices according to the present embodiment, but there is no limitation to these examples. The powder supply device can also be a wheat flour supply device provided with a plurality of hoppers capable of variously storing and supplying for example hard powder, medium powder, and soft powder. Furthermore, it can also be applied to devices that supply materials such as pulverized resins and the like. Overall, it applies to any type of powder that is stored.

Figure 9:
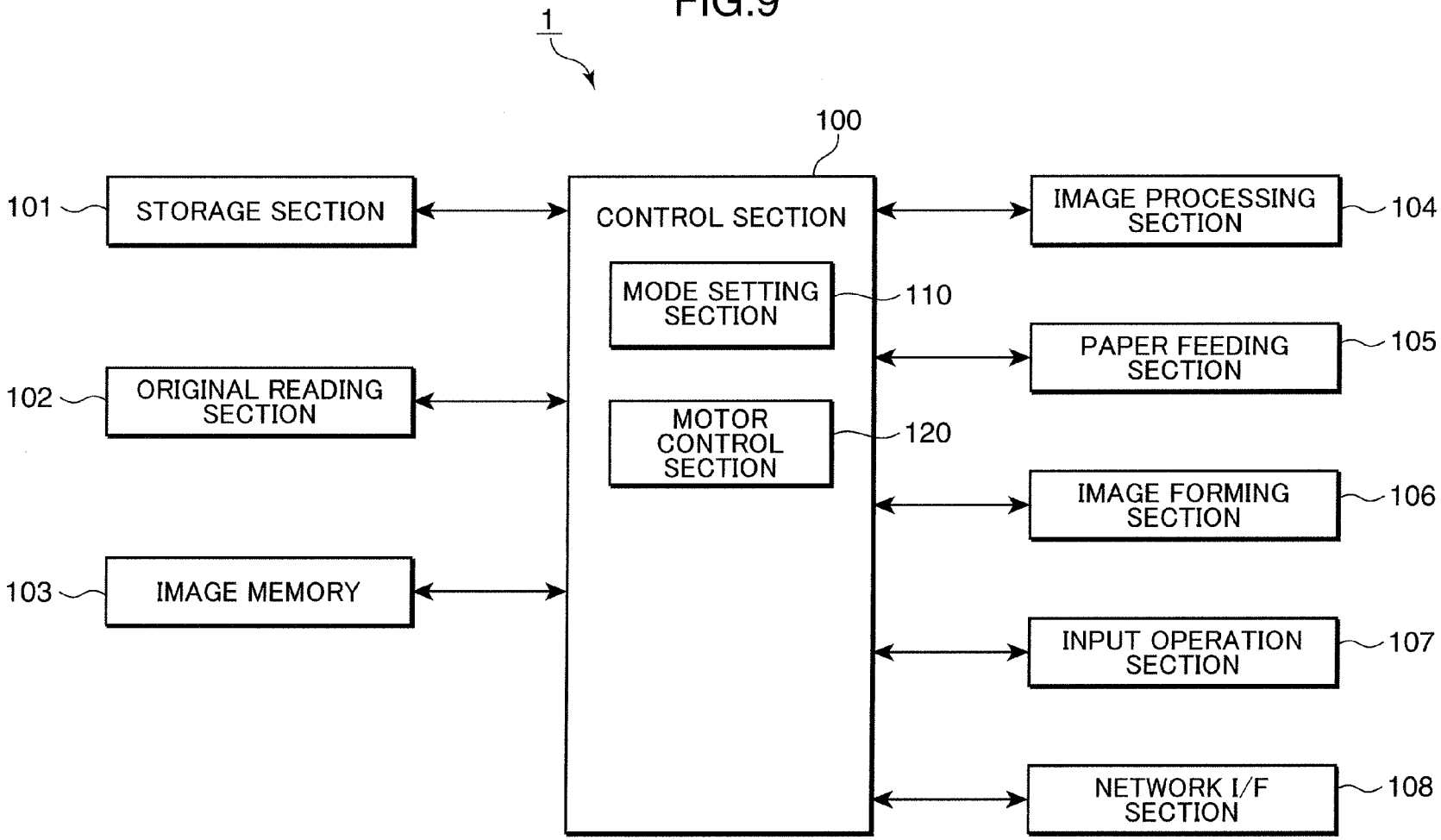
FIG. 9 is functional block diagram showing an electrical configuration of an image forming apparatus.

FIG. 9 is functional block diagram showing one example of an electrical configuration of an image forming apparatus 1. The image forming apparatus 1 is configured provided with a control section (control section) 100, a storage section 101, an original reading section 102, an image memory 103, an image processing section 104, a paper feeding section 105, an image forming section (image forming section) 106, an input operation section 107, and a network I/F section 108. It should be noted that the control section 100 is included in the components of the toner supply device 8 described above.

The storage section 101 stores programs and data for achieving the various functions provided in the image forming apparatus 1. The original reading section 102 reads an original using various image sensors and converts the image that has been read to image data.

The image memory 103 temporarily stores image data outputted from the original reading section 102 and image data that has been sent from external devices via the network I/F section 108. The image processing section 104 executes image processing such as image corrections and enlargements/reductions on the image data stored in the image memory 103. The paper feeding section 105 feeds out papers 23 sheet by sheet from the paper feeding cassettes 24 for transport to the image forming section 106.

The image forming section 106 forms an image on the paper 23 based on the image data stored in the image memory 103. The input operation section 107 is provided with a display panel and various operational buttons, and outputs operational signals to the control section 100 when operation is performed by a user. The network I/F section 108 is constituted by a communications module such as a LAN board, and carries out exchanges of various data with external devices via a network (not shown in diagram) connected to the network I/F section 108.

The control section 100 is constituted by a CPU (central processing unit) and performs comprehensive control of the image forming apparatus 1 and the toner supply device 8 by reading out programs stored in the storage section 101 in response to inputted instructional signals or the like.

The control section 100 is provided with a mode setting section 110 and a motor control section 120. The mode setting section 110 sets which of monochrome or color image forming is to be carried out based on an input operation of the user at the input operation section 107 or an ACS (auto color selection function) that automatically determines whether the original that has been read by the original reading section 102 is a black and white original or a color original.

The motor control section 120 causes forward direction rotational force by causing the shaft drive motor 94 to rotate in a forward direction when the mode setting section 110 has set for monochrome image forming to be carried out. As described earlier, this forward direction rotational force is transmitted only to the first shaft 9A, and therefore only the black toner stored in the toner hopper 80K is stirred.

On the other hand, the motor control section 120 causes reverse direction rotational force by causing the shaft drive motor 94 to rotate in a reverse direction when the mode setting section 110 has set for color image forming to be carried out. As described earlier, this reverse direction rotational force is transmitted to the first shaft 9A and the second shaft 9B, and therefore toners of all the colors stored in the toner hoppers 80K, 80Y, 80C, and 80M are stirred.

It should be noted that the motor control section 120 can cause reverse direction rotational force by causing the shaft drive motor 94 to rotate in a reverse direction at a preset timing regardless of whether the mode setting section 110 has set for either of monochrome or color image forming to be carried out. Here, examples of preset timings that can be given include a preset month and day, a time of day, and a time interval.

It should be noted that an invention having a following configuration is mainly included in the above-described specific embodiments.

A powder supply device according to one aspect of the present invention, comprising: a first storage section that stores powder; a second storage section that stores the powder; a first stirring section that is provided for stirring the powder stored in the first storage section and that is arranged inside the first storage section; a second stirring section that is provided for stirring the powder stored in the second storage section and that is arranged inside the second storage section; a drive section that produces a forward direction rotational force and a reverse direction rotational force to apply a drive force to the first and second stirring sections; a first transmission shaft that transmits the drive force to the first stirring section; a second transmission shaft that transmits the drive force to the second stirring section; and a transmission switching section that transmits the drive force produced by the forward direction rotational force of the drive section to the first transmission shaft, and that transmits the drive force produced by the reverse direction rotational force of the drive section to the first transmission shaft and the second transmission shaft.

With this configuration, the drive force produced by the forward direction rotational force of the drive section is transmitted to the first transmission shaft, but the drive force produced by the reverse direction rotational force of the drive section is transmitted to the first transmission shaft and the second transmission shaft. Thus, the drive force produced by the forward direction rotational force of the drive section is transmitted to the first stirring section through the first transmission shaft, but the drive force produced by the reverse direction rotational force of the drive section is transmitted to the first and second stirring sections through the second transmission shaft.

Accordingly, if the drive section rotates in the forward direction, the rotational force is transmitted to the first stirring section to stir the powder stored in the first storage section. On the other hand, if the drive section rotates in the reverse direction, the rotational force is transmitted to the first and second stirring sections to stir the powder stored in the first and second storage sections.

Accordingly, by performing control so as to cause the drive section to rotate in one direction of either the forward direction or the reverse direction, it is possible to prevent powder that is not be used from being stirred unnecessarily. Furthermore, electrical components (for example, a magnetic clutch or solenoid) are not required for controlling whether the drive force produced in the drive section is transmitted to a transmission section of either a first or second transmission section. Thus, there is no heat produced by continually running power to electrical components and toner deterioration can be prevented.

In the foregoing embodiment it is preferable that the transmission switching section includes: a first transmission section, to which the drive force is transmitted, and which further transmits the transmitted drive force to the first transmission shaft; a first unidirectional transmission section which contacts the first transmission section and transmits only the drive force, produced by the forward direction rotational force of the drive section, to the first transmission section; a second unidirectional transmission section which contacts the first transmission section and transmits only the drive force, produced by the reverse direction rotational force of the drive section, to the first transmission section; and a second transmission section constituted by a third unidirectional transmission section, which is provided at the second transmission shaft and which, when the drive force produced by either of the forward direction or reverse direction rotational force of the drive section is transmitted, further transmits only the drive force produced by the reverse direction rotational force of the drive section to the second transmission shaft.

With this configuration, the first unidirectional transmission section that contacts the first transmission section transmits the drive force produced by the forward direction rotational force of the drive section to only the first transmission section. On the other hand, the second unidirectional transmission section transmits the drive force produced by the reverse direction rotational force of the drive section to only the first transmission section. Furthermore, the second transmission section constituted by the third unidirectional transmission section, further transmits only the drive force produced by the reverse direction rotational force of the drive section to the second transmission shaft when the drive force produced by either of the forward direction or reverse direction rotational force of the drive section is transmitted.

Thus, the drive force produced by the forward direction rotational force of the drive section is transmitted to only the first transmission shaft. On the other hand, the drive force produced by the reverse direction rotational force of the drive section is transmitted to the first and second transmission shafts. Accordingly, a configuration necessary for switching the drive force produced by the rotation of the drive section so as to be transmitted to only the first transmission shaft or to be transmitted to the first and second transmission shaft in response to whether the drive section rotates in a direction of either the forward direction or the reverse direction can be easily configured using the first to third unidirectional transmission sections. Consequently, costs are curbed.

In the foregoing embodiment it is preferable that the transmission switching section includes: a first unidirectional transmission section which is provided at the first transmission shaft and transmits only the drive force, produced by the forward direction rotational force of the drive section, to the first transmission shaft; a second unidirectional transmission section which is provided at the first transmission shaft and transmits only the drive force, produced by the reverse direction rotational force of the drive section, to the first transmission shaft; and a third unidirectional transmission section which is provided at the second transmission shaft and transmits only the drive force, produced by the reverse direction rotational force of the drive section, to the second transmission shaft.

With this configuration, the first transmission shaft is provided with the first unidirectional transmission shaft, which transmits only the drive force produced by the forward direction rotational force of the drive section to the first transmission shaft, and the second unidirectional transmission section, which transmits only the drive force produced by the reverse direction rotational force of the drive section to the first transmission shaft. Furthermore, the second transmission shaft is provided with the third unidirectional transmission section, which transmits only drive force produced by the reverse direction rotational force of the drive section to the second transmission shaft.

Thus, the drive force produced by the forward direction rotational force of the drive section is transmitted to only the first transmission shaft. On the other hand, the drive force produced by the reverse direction rotational force of the drive section is transmitted to the first and second transmission shafts. Accordingly, the transmission switching section is configured using the first and second unidirectional transmission sections provided on the first transmission shaft and the third unidirectional transmission section provided on the second transmission shaft, and therefore the configuration of the transmission switching section is simplified. Consequently, costs are curbed.

Furthermore, the unidirectional transmission sections are provided on the first and second transmission shafts, and therefore drive force is directly transmitted to the first and second transmission shafts by the unidirectional transmission sections. Thus, a drive force having a large torque can be transmitted to the first and second transmission shafts. Accordingly, in a case where the first and second stirring sections are constituted by stirring paddles, the number of stirring paddles to which drive force is to be transmitted by the first transmission shaft and the second transmission shaft can be increased. Consequently, it is unnecessary to further add new transmission shafts through gears for increasing the torque to ends of the first transmission shaft and the second transmission shaft for increasing the number of stirring paddles.

In the foregoing embodiments it is preferable that the unidirectional transmission section is a unidirectional gear.

With this configuration, the unidirectional transmission section can be configured easily.

In the foregoing embodiments it is preferable that a control section is further included that causes the drive section to produce the rotational force of one of the forward direction and the reverse direction.

With this configuration, in response to a setting of rotational direction by the user, only the powder stored in the first storage section may be stirred, and powder stored in the first and second storage sections (powder stored in all the storage sections) may be stirred.

In the foregoing embodiments it is preferable that the control section causes the drive section to produce the rotational force of the reverse direction at a preset timing.

With this configuration, reverse direction rotational force is produced at preset timings. Thus, powder that is not stirred when the drive section rotates in the forward direction is stirred at the preset timings. Accordingly, powder that is not used ordinarily is stirred at the preset timings, and therefore it is possible to prevent the powder from solidifying undesirably.

In the foregoing embodiments it is preferable that the first storage section is a black-toner hopper that stores black toner, the second storage section is multiple-colors-toner hoppers, and each of the color toner hoppers stores toner of a different color, and the control section causes the drive section to produce the forward direction rotational force when only the black toner is to be supplied, but causes the drive section to produce the reverse direction rotational force when the black toner and the color toners are to be supplied.

With this configuration, when image forming is to be carried out using only the black toner stored in the first storage section, the control section causes the drive section to produce forward direction rotational force to stir only the first stirring section using the first transmission shaft. On the other hand, when image forming is to be carried out using toners of all the colors stored in the first and second storage sections, the control section causes the drive section to produce reverse direction rotational force to stir the first and second stirring sections using the first and second transmission shafts.

Thus, when image forming is to be carried out using only black toner, only the black toner is stirred. On the other hand, when image forming is to be carried out using toners of all the colors, the toners of all the colors are stirred. Accordingly, only toners of the colors to be used are stirred, and toners of colors not to be used are not stirred, and therefore it is possible to prevent the toners from being stirred unnecessarily.

Furthermore, an image forming apparatus according to another aspect of the present invention, comprising: a powder supply device including a first storage section that stores toner as powder; a second storage section that stores toner as the powder; a first stirring section that is provided for stirring the toner stored in the first storage section and that is arranged inside the first storage section; a second stirring section that is provided for stirring the toner stored in the second storage section and that is arranged inside the second storage section; a drive section that produces a forward direction rotational force and a reverse direction rotational force to apply a drive force to the first and second stirring sections; a first transmission shaft that transmits the drive force to the first stirring section; a second transmission shaft that transmits the drive force to the second stirring section; and a transmission switching section that transmits the drive force produced by the forward direction rotational force of the drive section to the first transmission shaft, and transmits the drive force produced by the reverse direction rotational force of the drive section to the first transmission shaft and the second transmission shaft, the image forming apparatus further comprising an image forming section that carries out image forming using the toners.

With this configuration, the drive force produced by the forward direction rotational force of the drive section is transmitted to the first transmission shaft, but the drive force produced by the reverse direction rotational force of the drive section is transmitted to the first drive shaft and the second drive shaft. Thus, the drive force produced by the forward direction rotational force of the drive section is transmitted to the first stirring section through the first transmission shaft, but the drive force produced by the reverse direction rotational force of the drive section is transmitted to the first and second stirring sections through the second transmission shaft.

Accordingly, if the drive section rotates in the forward direction, the rotational force is transmitted to the first stirring section to stir the powder stored in the first storage section. On the other hand, if the drive section rotates in the reverse direction, the rotational force is transmitted to the first and second stirring sections to stir the powder stored in the first and second storage sections.

Accordingly, by performing control so as to cause the drive section to rotate in one direction of either the forward direction or the reverse direction, it is possible to prevent powder that is not be used from being stirred unnecessarily. Furthermore, electrical components (for example, a magnetic clutch or solenoid) are not required for controlling whether the drive force produced in the drive section is transmitted to a transmission section of either a first or second transmission section. Thus, there is no heat produced by continually running power to electrical components and toner deterioration can be prevented.

In the foregoing embodiments it is preferable that the transmission switching section of the powder supply device includes: a first transmission section, to which the drive force is transmitted, and which further transmits the transmitted drive force to the first transmission shaft; a first unidirectional transmission section which contacts the first transmission section and transmits only the drive force, produced by the forward direction rotational force of the drive section, to the first transmission section; a second unidirectional transmission section which contacts the first transmission section and transmits only the drive force, produced by the reverse direction rotational force of the drive section, to the first transmission section; and a second transmission section constituted by a third unidirectional transmission section which is provided at the second transmission shaft and which, when the drive force produced by either of the forward direction or reverse direction rotational force of the drive section is transmitted, further transmits only the drive force, produced by the reverse direction rotational force of the drive section, to the second transmission shaft.

With this configuration, the first unidirectional transmission section that contacts the first transmission section transmits the drive force produced by the forward direction rotational force of the drive section to only the first transmission section. On the other hand, the second unidirectional transmission section transmits the drive force produced by the reverse direction rotational force of the drive section to only the first transmission section. Furthermore, the second transmission section constituted by the third unidirectional transmission section, further transmits only the drive force produced by the reverse direction rotational force of the drive section to the second transmission shaft when the drive force produced by either of the forward direction or reverse direction rotational force of the drive section is transmitted.

Thus, the drive force produced by the forward direction rotational force of the drive section is transmitted to only the first transmission shaft. On the other hand, the drive force produced by the reverse direction rotational force of the drive section is transmitted to the first and second transmission shafts. Accordingly, a configuration necessary for switching the drive force produced by the rotation of the drive section so as to be transmitted to only the first transmission shaft or to be transmitted to the first and second transmission shafts in response to whether the drive section rotates in a direction of either the forward direction or the reverse direction can be easily configured using the first to third unidirectional transmission sections. Consequently, costs are curbed.

In the foregoing embodiments it is preferable that the transmission switching section of the powder supply device includes: a first unidirectional transmission section which is provided at the first transmission shaft and transmits only the drive force, produced by the forward direction rotational force of the drive section, to the first transmission shaft; a second unidirectional transmission section which is provided at the first transmission shaft and transmits only the drive force, produced by the reverse direction rotational force of the drive section, to the first transmission shaft; and a third unidirectional transmission section which is provided at the second transmission shaft and transmits only the drive force, produced by the reverse direction rotational force of the drive section, to the second transmission shaft.

With this configuration, the first transmission section is provided with the first unidirectional transmission section, which transmits only the drive force produced by the forward direction rotational force of the drive section to the first transmission shaft, and the second unidirectional transmission section, which transmits only the drive force produced by the reverse direction rotational force of the drive section to the first transmission shaft. Furthermore, the second transmission shaft is provided with the third unidirectional transmission section, which transmits only drive force produced by the reverse direction rotational force of the drive section to the second transmission shaft.

Thus, the drive force produced by the forward direction rotational force of the drive section is transmitted to only the first transmission shaft. On the other hand, the drive force produced by the reverse direction rotational force of the drive section is transmitted to the first and second transmission shafts. Accordingly, the transmission switching section is configured using the first and second unidirectional transmission sections provided on the first transmission shaft and the second unidirectional transmission section provided on the second transmission shaft, and therefore the configuration of the transmission switching section is simplified. Consequently, costs are curbed.

Furthermore, the unidirectional transmission sections are provided on the first and second transmission shafts, and therefore drive force is directly transmitted to the first and second transmission shafts by the unidirectional transmission sections. Thus, a drive force having a large torque can be transmitted to the first and second transmission shafts. Accordingly, in a case where the first and second stirring sections are constituted by stirring paddles, the number of stirring paddles to which drive force is to be transmitted by the first transmission shaft and the second transmission shaft can be increased. Consequently, it is unnecessary to further add new transmission shafts through gears for increasing the torque to ends of the first transmission shaft and the second transmission shaft for increasing the number of stirring paddles.

In the foregoing embodiments it is preferable that the unidirectional transmission section of the powder supply device is a unidirectional gear.

With this configuration, the unidirectional transmission section can be configured easily.

In the foregoing embodiments it is preferable that a control section is further included that causes the drive section to produce rotational force of one of the forward direction and the reverse direction.

With this configuration, in response to a setting of rotational direction by the user, only the powder stored in the first storage section may be stirred, and powder stored in the first and second storage sections (powder stored in all the storage sections) may be stirred.

In the foregoing embodiments it is preferable that the control section causes the drive section to produce the rotational force of the reverse direction at a preset timing.

With this configuration, reverse direction rotational force is produced at preset timings. Thus, powder that is not stirred when the drive section rotates in the forward direction is stirred at the preset timings. Accordingly, powder that is not used ordinarily is stirred at the preset timings, and therefore it is possible to prevent the powder from solidifying undesirably.

In the foregoing embodiments it is preferable that the first storage section is a black-toner hopper that stores black toner, the second storage section is multiple-colors-toner hoppers, and each of the color toner hoppers stores a color toner of a different color from each other, and the control section causes the drive section to produce the forward direction rotational force when image forming is to be carried out by the image forming section using only the black toner, but causes the drive section to produce the reverse direction rotational force when image forming is to be carried out by the image forming section using the black toner and the color toners.

With this configuration, when image forming is to be carried out using only the black toner stored in the first storage section, the control section causes the drive section to produce forward direction rotational force to stir only the first stirring section using the first drive shaft. On the other hand, when image forming is to be carried out using toners of all the colors stored in the first and second storage sections, the control section causes the drive section to produce reverse direction rotational force to stir the first and second stirring sections using the first and second drive shafts.

Thus, when image forming is to be carried out using only black toner, only the black toner is stirred. On the other hand, when image forming is to be carried out using toners of all the colors, the toners of all the colors are stirred. Accordingly, only toners of the colors to be used are stirred, and toners of colors not to be used are not stirred, and therefore it is possible to prevent the toners from being stirred unnecessarily.

This application is based on Japanese Patent application serial No. 2009-107763 filed in Japan Patent Office on Apr. 27, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A powder supply device, comprising:

a first storage section that stores powder;

a second storage section that stores the powder;

a first stirring section that is provided for stirring the powder stored in the first storage section and that is arranged inside the first storage section;

a second stirring section that is provided for stirring the powder stored in the second storage section and that is arranged inside the second storage section;

a drive section that produces a forward direction rotational force and a reverse direction rotational force to apply a drive force to the first and second stiring sections;

a first transmission shaft that transmits the drive force to the first stirring section;

a second transmission shaft that transmits the drive force to the second stirring section; and a transmission switching section that transmits the drive force produced by the forward direction rotational force of the drive section to the first transmission shaft, and that transmits the drive force produced by the reverse direction rotational force of the drive section to the first transmission shaft and the second transmission shaft.

2. The powder supply device according to claim 1, wherein the transmission switching section comprises:

a first transmission section, to which the drive force is transmitted, and which further transmits the transmitted drive force to the first transmission shaft;

a first unidirectional transmission section which contacts the first transmission section and transmits only the drive force, produced by the forward direction rotational force of the drive section, to the first transmission section;

a second unidirectional transmission section which contacts the first transmission section and transmits only the drive force, produced by the reverse direction rotational force of the drive section, to the first transmission section; and a second transmission section constituted by a third unidirectional transmission section, which is provided at the second transmission shaft and which, when the drive force produced by either of the forward direction or reverse direction rotational force of the drive section is transmitted, further transmits only the drive force produced by the reverse direction rotational force of the drive section to the second transmission shaft.

3. The powder supply device according to claim 2, wherein at least one of the unidirectional transmission sections is a unidirectional gear.

4. The powder supply device according to claim 1, wherein the transmission switching section comprises:

a first unidirectional transmission section which is provided at the first transmission shaft and transmits only the drive force, produced by the forward direction rotational force of the drive section, to the first transmission shaft;

a second unidirectional transmission section which is provided at the first transmission shaft and transmits only the drive force, produced by the reverse direction rotational force of the drive section, to the first transmission shaft; and a third unidirectional transmission section which is provided at the second transmission shaft and transmits only the drive force, produced by the reverse direction rotational force of the drive section, to the second transmission shaft.

5. The powder supply device according to claim 3, wherein at least one of the unidirectional transmission sections is a unidirectional gear.

6. The powder supply device according to claim 1, further comprising a control section that causes the drive section to produce a rotational force of one of the forward direction and the reverse direction.

7. The powder supply device according to claim 6, wherein the control section causes the drive section to produce a rotational force of the reverse direction at a preset timing.

8. The powder supply device according to claim 6, wherein the first storage section is a black-toner hopper that stores black toner, and the second storage section is multiple-colors-toner hoppers, and each of the color toner hoppers stores a toner of a different color, and the control section causes the drive section to produce the forward direction rotational force when only the black toner is to be supplied, but causes the drive section to produce the reverse direction rotational force when the black toner and the color toners are to be supplied.

9. An image forming apparatus, comprising a powder supply device including:

a first storage section that stores toner as powder;

a second storage section that stores toner as the powder;

a first stirring section that is provided for stirring the toner stored in the first storage section and that is arranged inside the first storage section;

a second stirring section that is provided for stirring the toner stored in the second storage section and that is arranged inside the second storage section;

a drive section that produces a forward direction rotational force and a reverse direction rotational force to apply a drive force to the first and second stirring sections;

a first transmission shaft that transmits the drive force to the first stirring section;

a second transmission shaft that transmits the drive force to the second stirring section; and a transmission switching section that transmits the drive force produced by the forward direction rotational force of the drive section to the first transmission shaft, and transmits the drive force produced by the reverse direction rotational force of the drive section to the first transmission shaft and the second transmission shaft, the image forming apparatus further comprising an image forming section that carries out image forming using the toner.

10. The image forming apparatus according to claim 9, wherein the transmission switching section of the powder supply device comprises:

a first transmission section, to which the drive force is transmitted, and which further transmits the transmitted drive force to the first transmission shaft;

a first unidirectional transmission section which contacts the first transmission section and transmits only the drive force, produced by the forward direction rotational force of the drive section, to the first transmission section;

a second unidirectional transmission section which contacts the first transmission section and transmits only the drive force, produced by the reverse direction rotational force of the drive section, to the first transmission section; and a second transmission section constituted by a third unidirectional transmission section which is provided at the second transmission shaft and which, when the drive force produced by either of the forward direction or reverse direction rotational force of the drive section is transmitted, further transmits only the drive force, produced by the reverse direction rotational force of the drive section, to the second transmission shaft.

11. The image forming apparatus according to claim 10, wherein at least one of the unidirectional transmission sections of the powder supply device is a unidirectional gear.

12. The image forming apparatus according to claim 9, wherein the transmission switching section of the powder supply device comprises:

a first unidirectional transmission section which is provided at the first transmission shaft and transmits only the drive force, produced by the forward direction rotational force of the drive section, to the first transmission shaft;

a second unidirectional transmission section which is provided at the first transmission shaft and transmits only the drive force, produced by the reverse direction rotational force of the drive section, to the first transmission shaft; and a third unidirectional transmission section which is provided at the second transmission shaft and transmits only the drive force, produced by the reverse direction rotational force of the drive section, to the second transmission shaft.

13. The image forming apparatus according to claim 12, wherein at least one of the unidirectional transmission sections of the powder supply device is a unidirectional gear.

14. The image forming apparatus according to claim 9, further comprising a control section that causes the drive section to produce rotational force of one of the forward direction and the reverse direction.

15. The image forming apparatus according to claim 14, wherein the control section causes the drive section to produce the rotational force of the reverse direction at a preset timing.

16. The image forming apparatus according to claim 14, wherein the first storage section is a black-toner hopper that stores black toner, and the second storage section is multiple-colors-toner hoppers, and each of the color toner hoppers stores toner of a different color, and the control section causes the drive section to produce the forward direction rotational force when image forming is to be carried out by the image forming section using only the black toner, but causes the drive section to produce the reverse direction rotational force when image forming is to be carried out by the image forming section using the black toner and the color toners.

* * * * *